US005393311A

United States Patent [19]

Marhanka

[11] Patent Number: 5,393,311

[45] Date of Patent: Feb. 28, 1995

[54] METHOD AND APPARATUS FOR DESULFURIZING COAL

[76] Inventor: Frank D. Marhanka, 580 Cromwell Way, Lexington, Ky. 40503

[21] Appl. No.: 20,102

[22] Filed: Feb. 19, 1993

[51] Int. Cl.[6] ..... C10L 9/10; C10B 57/00

[52] U.S. Cl. ..... 44/622; 44/629; 201/17

[58] Field of Search ..... 44/622, 623, 629; 201/17

[56] References Cited

U.S. PATENT DOCUMENTS

| | | | |
|---|---|---|---|
| 4,076,607 | 2/1978 | Zavitsanos et al. | 44/622 |
| 4,089,656 | 5/1978 | Cole | 44/623 |
| 4,123,230 | 10/1978 | Kirkbride | 44/623 |
| 4,146,367 | 3/1979 | Hsu | 44/623 |
| 4,148,614 | 4/1979 | Kirbridge | 44/624 |
| 4,156,593 | 5/1979 | Tarpley, Jr. | 44/620 |
| 4,175,924 | 11/1979 | Kindig | 44/623 |
| 4,205,919 | 6/1980 | Attwell | 366/34 |
| 4,234,402 | 11/1980 | Kirkbridge | 208/209 |
| 4,270,928 | 6/1981 | Frischmuth | 44/622 |
| 4,435,374 | 3/1984 | Helm, Jr. | 423/415 A |

*Primary Examiner*—Margaret Medley
*Attorney, Agent, or Firm*—Rogers, Howell & Haferkamp

[57] ABSTRACT

A method and apparatus for desulfurizing coal is provided. The method involves combining non-pulverized sulfur containing coal with an adsorbent material, such as aluminum oxide, in a vessel, irradiating the coal/adsorbent combination with microwave energy sufficient to subject the coal/adsorbent combination to a temperature of between about 250° F. and about 650° F. for a period of time sufficient to cause the release of sulfur from the coal as a gas. A magnetic field may be provided around the vessel to concentrate the microwave energy being introduced into the vessel within the vicinity of the magnetic field to enhance the release of the sulfur from the coal. The adsorbent is admixed with the coal during and after the heating step to adsorb some of the gaseous sulfur liberated from the coal. The apparatus capable of performing this method includes a heating section, a mixing section, a screening section and a gas treatment section. The sulfur containing gas liberated from the coal is vacuumed from the heating section into the gas treatment section where it is subjected to processing into sulfuric acid. The mixing section performs the admixing of the coal/adsorbent and the screening section separates the adsorbent from the coal and includes an apparatus for directing the coal or the adsorbent to individual receiving and/or conveying receptacles.

15 Claims, 5 Drawing Sheets

METHOD AND APPARATUS FOR DESULFURIZING COAL

BACKGROUND OF THE INVENTION

This invention relates in general to a method and apparatus for removing sulfur from coal and, more particularly, to such a method that employs microwave energy to cause the release of the sulfur from the coal and removes the gaseous sulfur from the atmosphere surrounding the coal by applying a vacuum and by mixing an adsorbent material with the coal, and an apparatus adapted to perform such method.

The environmental problems associated with the burning of high-sulfur coal are well documented. One of the most significant problems is the release of sulfur dioxide into the atmosphere during the burning process which contributes to the effects of acid rain. In an attempt to reduce the effects of acid rain and other environmental problems associated with the burning of high sulfur coal, governmental regulations have been enacted which limit the amount of sulfur dioxide that can be emitted from a facility, such as a power plant, utilizing coal as an energy source. These regulations are most readily followed by utilizing .low sulfur containing coal. Unfortunately, much of the coal located in the Midwestern and Eastern portions of the United States is considered high sulfur coal and cannot be effectively utilized within the governmental regulations. This fact drastically limits the use of a significant amount of the coal reserves in the United States as an energy source.

Various methods have been proposed to remove or reduce the level of sulfur in high sulfur coal. None of these methods have, however, received widespread acceptance within the coal industry because they are either ineffective or too expensive for commercial use. One conventional solution, the use of wet-scrubbers or dry-scrubbers to treat the sulfur gases emitted during the burning of high sulfur coal, has proved to be extremely costly and not altogether acceptable in terms of solving the sulfur emission problem. Other methods employing chemical treatment of the coal to separate the sulfur from the coal have been developed, but have generally proved to be ineffective or too costly to pursue on a large scale. There is, therefore, a need in the coal industry for an effective and economical method for desulfurizing coal on a large scale and an apparatus that facilitates the practice of such method which overcome the foregoing problems.

SUMMARY OF THE INVENTION

The present invention is directed to a novel method and apparatus for desulfurizing coal. The method comprises combining non-pulverized sulfur containing coal with an adsorbent material in a vessel, irradiating this combination with microwave energy sufficient to subject the coal/adsorbent combination to a temperature of between about 250° F. and about 650° F. for a period of time sufficient to cause the release of sulfur from the coal as a gas. The sulfur containing gas is removed from the vessel and the coal/adsorbent combination is mixed in a manner enabling the adsorption of any remaining gaseous sulfur onto adsorbent. The adsorbent is then separated from the coal. The preferred adsorbent is aluminum oxide and the microwave energy introduced is between about 200 and about 4000 watts, preferably between about 500–2500 watts depending upon the size and amount of the coal being irradiated, at a frequency of about 2000 to about 4000 MHz. A magnetic field is also provided surrounding the vicinity of the application of the microwave energy to concentrate the microwave energy to the coal/adsorbent combination in the vessel.

The present invention is further directed to an apparatus that facilitates the desulfurization of coal by the method of this invention. The apparatus is comprised of four primary sections: a heating section, a mixing section, a screening section and a gas treatment section. The first section is the heating section and comprises a vessel having an interior volume, an access opening at one end for receiving the coal and adsorbent material into the vessel, a discharge opening at a second end for discharging the coal/adsorbent mixture from the vessel, a source of microwave energy for irradiating the coal/adsorbent mixture received within the vessel, and an auger for moving the coal/adsorbent mixture through the vessel. The mixing section comprises a second vessel having an interior volume into which the coal/adsorbent mixture from the first vessel is introduced. The second vessel has an access opening to receive the coal/adsorbent from the first vessel, a discharge opening and an auger which mixes and moves the coal/adsorbent from the access opening to the discharge opening of the second vessel. The screening section comprises a third vessel having an interior volume, an access opening to receive the coal/adsorbent from the second vessel, a discharge opening, an auger for moving the coal/adsorbent from the access opening to the discharge opening, and a system for selectively discharging the coal and/or the adsorbent from the third vessel. The gas treatment section comprises a series of conduits in communication with the interior of the first vessel which are connected to a source of vacuum to remove the sulfur containing gas created by the microwave energy heat treatment. A vacuum is applied to the conduit which draws the gas from the first vessel through the conduit and into a series of pipes into a holding tank. In the holding tank, the gas is pressurized into liquid sulfuric acid in the presence of sufficient oxygen and water, or bubbled into liquid sulfuric acid, to form sulfuric acid as a by-product.

The apparatus further includes a discharge chute coupled to the third vessel which directs the coal or adsorbent discharged from the third vessel to individual receiving and/or conveying receptacles. In accordance with the practice of the method of this invention with this apparatus, a magnetic field is also preferably provided in connection with the source of microwave energy in the heating section of the apparatus and surrounding the vessel wherein the microwave energy is being introduced. The present invention is also directed to a coal desulfurizing system which comprises a plurality of such apparatuses as described above coupled together in such a manner as to permit the apparatuses to work in unison which enables the efficient desulfurization of a large quantity of coal on a commercially feasible scale.

Among the many advantages found to be achieved by the present invention may be noted the provision of a method for desulfurizing coal that removes a significant amount of the sulfur in the coal without significantly affecting the BTU factor of the coal; the provision of such method that can accommodate a wide range of sizes of coal direct from the mine without the need for preliminary processing of the coal; the provision of such method that removes the sulfur released as a gas from the coal from the system and subjects it to further treatment to produce useful by-products; and the provision of an apparatus and a system adapted to perform such method.

DETAILED DESCRIPTION OF THE PREFERRED EMBODIMENTS

Figure 1:
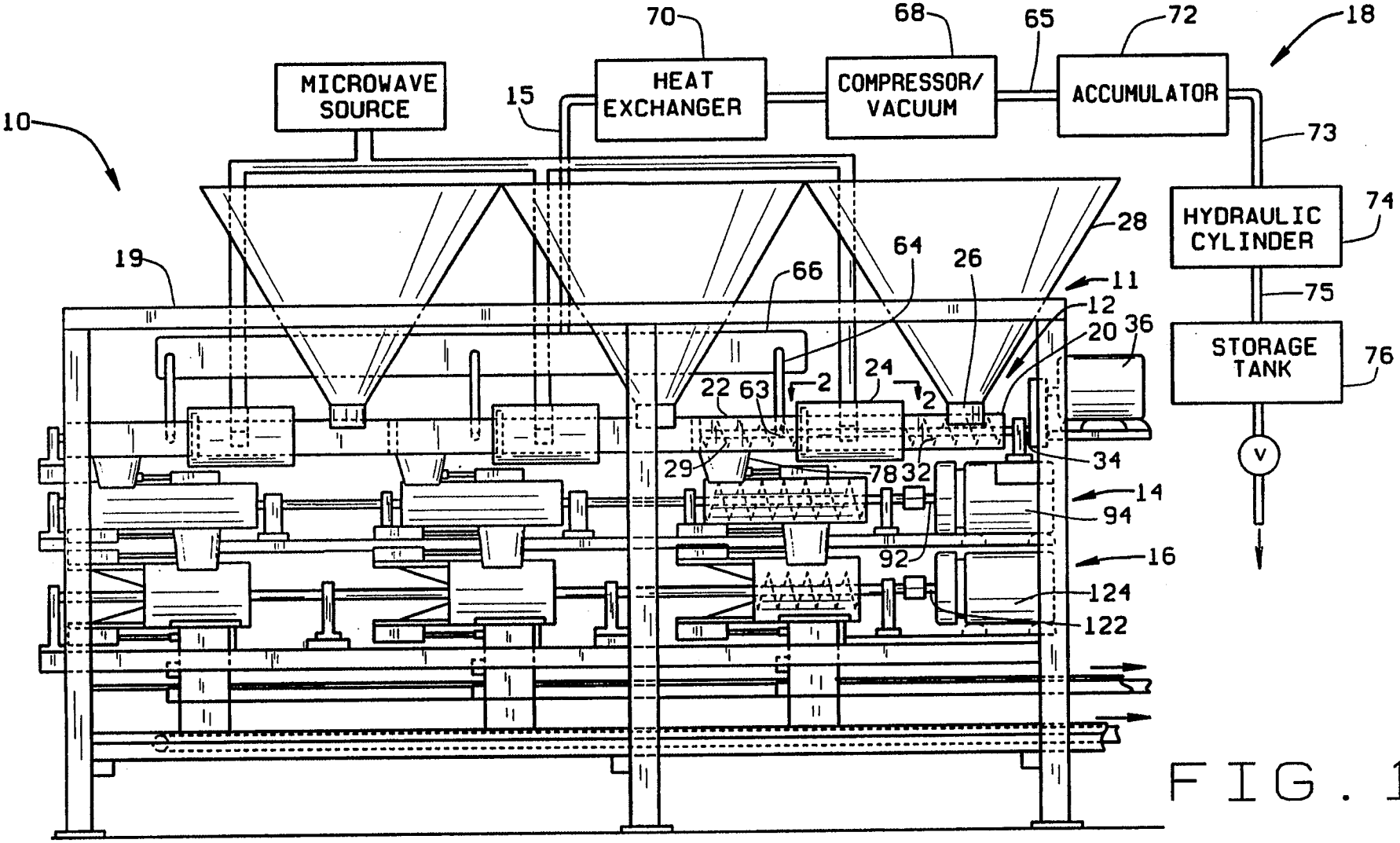
FIG. 1 is a front elevation view and schematic of the apparatus and system of one embodiment of the present invention.

In accordance with the present invention, it has been discovered that a significant portion of the sulfur in sulfur containing coal can be removed by combining the sulfur containing coal with an adsorbent material in a vessel and irradiating the coal and adsorbent combination with microwave energy sufficient to subject the combination to a temperature of between about 250° F. and about 650° F. for a period of time sufficient to cause the release of sulfur from the coal as a gas. As the coal and adsorbent are being heated, the sulfur is released from the coal as a gas and is either adsorbed by the adsorbent or is removed from the vessel by applying a vacuum to the vessel to remove the gaseous sulfur therefrom. After the coal and adsorbent combination has been irradiated and the gas emitted from the coal as a result of this heating step, the coal and the adsorbent combination is intimately mixed to enable the adsorption of any remaining gaseous sulfur onto the adsorbent particles. The adsorbent is then separated from the coal and the coal conveyed to a site for further processing or use as an energy source.

Preferably, the adsorbent used in the method of this invention is aluminum oxide particles. Small aluminum oxide particles that are capable of passing through a 200–300 mesh screen are preferred and are mixed with the coal in a ratio of coal:aluminum oxide of at least 10:1. The aluminum oxide acts as an adsorbent to adsorb the gaseous sulfur compounds emitted during the heating step of the desulfurizing process. The aluminum oxide particles used in connection with the method of this invention are readily available in the industry.

The microwave energy supplied to the vessel and the coal and aluminum oxide combination is from a conventional source of microwave energy and is provided in an amount sufficient to subject the coal and aluminum oxide combination to a temperature of between about 250° F. and about 650° F. and, more preferably, between a temperature of about 250° F. and about 450° F. The frequency of the microwave energy necessary to cause the sulfur to be released from the coal is preferably between about 2000 and about 4000 MHz, while the microwave energy is in the range of between about 200 and about 4000 watts, preferably between 500 and 2500 watts. The frequency and wattage of the microwave energy is determined by the size and amount of the coal particles being processed. When larger sizes of coal or large amounts of coal are being processed, higher frequencies and wattage will be necessary to cause the release of a sufficient amount of the sulfur in the coal. The coal and aluminum oxide combination is irradiated with the microwave energy at the desired frequency and watt energy for a period of time sufficient to liberate the sulfur from the coal as a gas, with mixing. It has been found that treatment according to this method can remove about 75% of the sulfur from the coal. When large chunks of coal are used in this method, it may be necessary to subject the coal with an amount of microwave energy to attain a temperature of about 650° F. for a period of between about 5 and 45 seconds, preferably between 5 and 30 seconds, to cause the release of a sufficient amount of sulfur.

In order to concentrate the microwave energy-applied into the vessel to the mass of coal and aluminum oxide introduced therein, a magnetic field is provided surrounding the vicinity of the vessel where the coal and aluminum oxide combination is being irradiated. When sulfur is removed from coal in this manner, about 75% of the sulfur in the coal on a dry weight basis is removed Further details of the method are provided in connection with the description of an apparatus for carrying out this method as hereinafter described.

Referring to FIG. 1, a system for desulfurizing coal and treating the gaseous sulfur released from the coal is designated generally by the numeral 10 and an apparatus to perform such method is designated generally by the numeral 11. The apparatus 11 comprises four primary sections: a heating section designated generally by the numeral 12; a mixing section designated generally by the numeral 14; a screening section designated generally by the numeral 16 and a gas treatment section designated generally by the numeral 18. The apparatus 11 is provided within and supported by a frame work 19 and preferably arranged in the manner as shown in FIG. 1.

Referring initially to the heating section 12, a pair of auger tubes 20 and 22 and a heating chamber 24 are coupled together in an end-to-end relationship with the heating chamber 24 positioned between the auger tubes 20 and 22 to form the first vessel in which the coal and aluminum oxide are introduced. The auger tube 20 has an access opening 26 on its upper surface at its end distal to the heating chamber 24 to receive the coal and aluminum oxide which are introduced through a funnel shaped hopper 28. The second auger tube 22 has a discharge opening 29 on its underside at its end distal to the heating chamber 24 for discharging the coal and aluminum oxide from the second auger tube 22 as will be described hereinafter.

The coal introduced into the hopper 28 in connection with this invention is of a wide range of sizes ranging from small stoker size to super stoker size coal, but need not be crushed or pulverized. In fact, coal introduced into this system and used in the method of this invention preferably has only been washed and impurities removed by conventional screening and washing processes.

Figure 2:
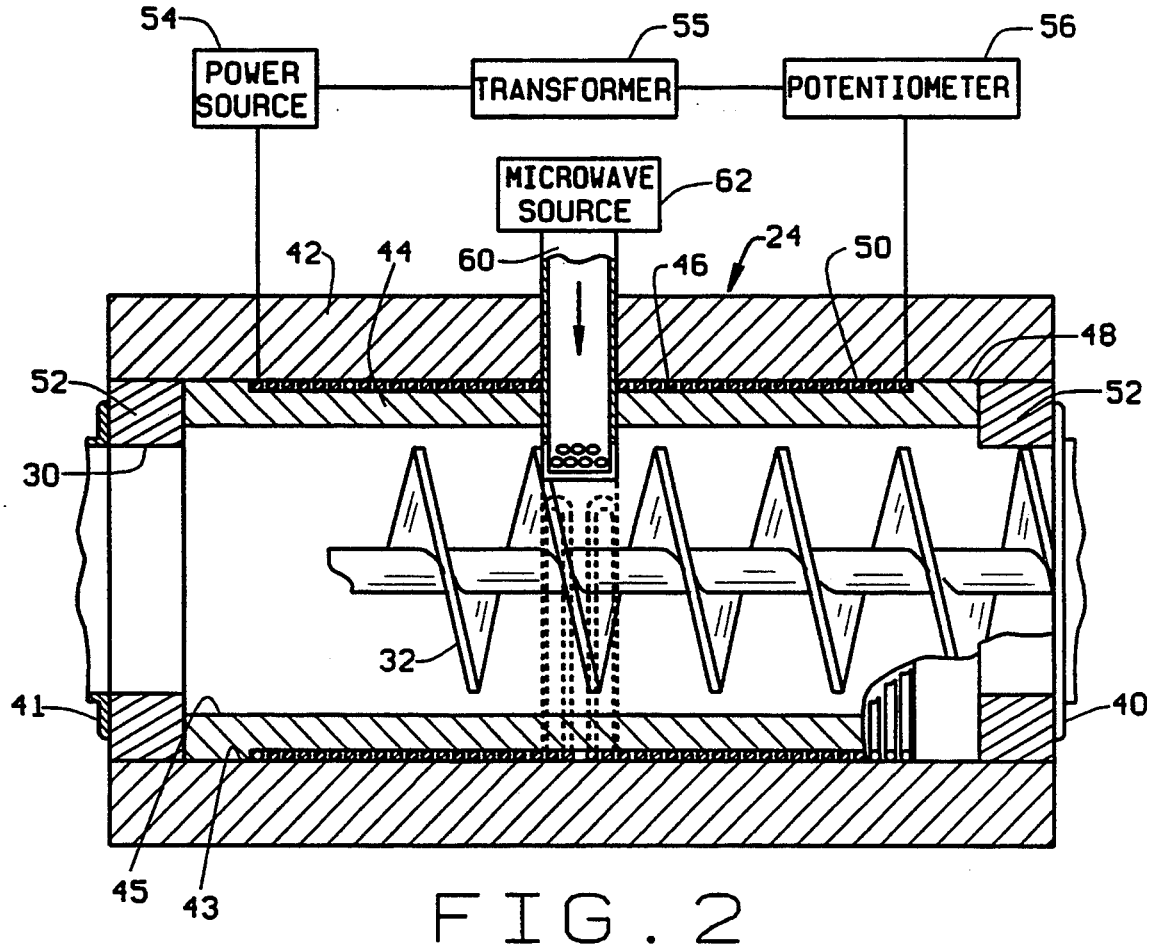
FIG. 2 is an enlarged sectional view through the plane of the line 2—2 in FIG. 1.

A cylindrical opening 30 is presented longitudinally through each of the auger tubes 20 and 22 and the heating chamber 24. A helical auger 32 coupled to a shaft 34 is mounted for rotational movement within the cylindrical opening 30. The auger 32 extends the entire longitudinal length of the opening 30 from the distal end of the auger tube 20 to the distal end of the tube 22. The auger has a drive shaft 34 that is in driving connection to a motor 36 to provide the rotational movement of the auger 32. The auger 32 serves to move the coal and aluminum oxide from the first auger tube 20 through the heating chamber 24 and into the second auger tube 22. Preferably, the motor 36 is a 30 horsepower, three phase motor. Auger tubes 20 and 22 are both preferably made of a durable material, such as metal, as is the auger 32. As shown in FIG. 2, annular flanges 40 and 41 are provided on the proximate end of each of auger tubes 20 and 22, respectively. The flanges 40 and 41 of the auger tubes 20 and 22 are connected to the opposite ends of the heating chamber 24, respectively and secured thereto by conventional means.

Figure 3:
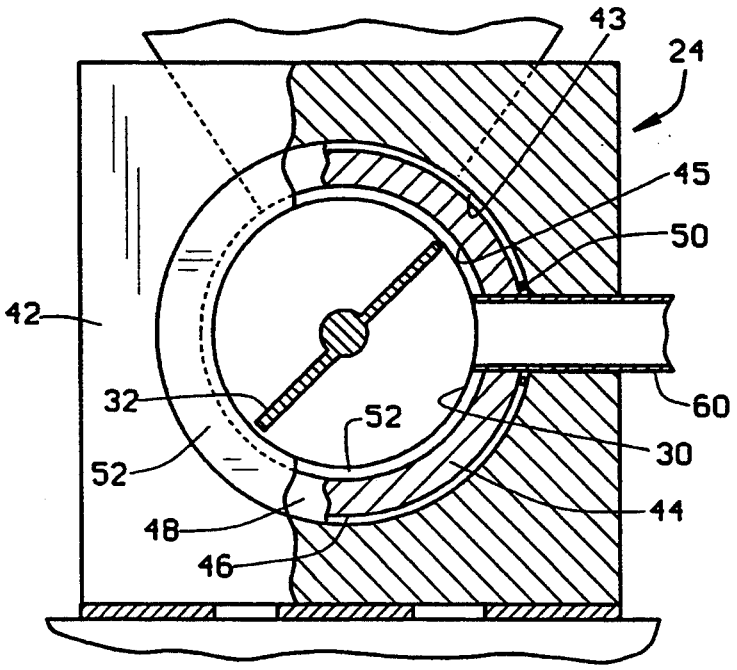
FIG. 3 is an enlarged partially sectional end view of the heating section of the embodiment of the invention as shown in FIG. 1.

Referring to FIGS. 2 and 3, the heating chamber 24 is comprised of a rectangular jacket 42 through which a longitudinal cylindrical opening 43 having a diameter larger than cylindrical opening 30 is formed. Into this opening, a generally cylindrical sleeve 44 is inserted. The sleeve 44 also has a cylindrical opening 45 running the longitudinal length of the sleeve 44 having a diameter sufficient to receive the auger 32 therethrough. An annular recess 46 is presented in the outside surface of the sleeve 44 which forms a pair of annular shoulders 48 on opposite ends of the sleeve 44. The annular recess 46 is of a depth to accommodate a coiled wire winding 50 therein. The sleeve 44 is of a slightly shorter length than jacket 42 and, after the insertion of the sleeve 44 into the jacket 42, a pair of annular neoprene collars 52 are positioned at each end of the opening of jacket 42 to hold sleeve 44 securely in place and to provide a surface on which to connect annular flanges 40 and 41 of auger tubes 20 and 22, respectively, to the heating chamber 24. Thus, the metal auger tubes 20 and 22 do not extend into the heating chamber 24. As will be described hereinafter, microwave energy is introduced into the interior volume of the heating chamber in accordance with the method of this invention. Therefore, the jacket 42 and sleeve 44 are formed of a non-metallic material that is capable of being subjected to microwave energy without adverse consequences. Preferably, the jacket 42 and sleeve 44 are therefore composed of a conventional tile or ceramic material known and used by those skilled in art. Similarly, the auger 32 is coated with a non-metallic coating, such as plastic, so as not to interfere with the introduction of the microwave energy into the interior volume of the heating chamber 24. In a preferred embodiment, the jacket 42 is a 4'×4'×7' rectangular box and the cylindrical opening 43 therethrough is 36" in diameter. The outside diameter of the sleeve 44 is approximately 33" and the sleeve is approximately 70½" long. The cylindrical opening through the sleeve 44 is approximately 25½" in diameter and the annular recess 46 is approximately 7/8" deep and 60" long leaving approximately 6" shoulders 48 on each end of the sleeve 44. The neoprene collars 52 are approximately 36" in outside diameter to provide a close fit with the inside diameter of the inner surface of jacket 42.

The coiled wire winding 50 is connected to an outside power source 54 through openings (not shown) cored into jacket 42 to create an electrical current through the wire winding 50. Preferably, a transformer 55 and a potentiometer 56 are provided in the line of the power source 54 and the coil wire winding 50. The coiled wire winding 50 is preferably composed of ten gauge copper enamel wire and is helically wound throughout the length of the annular recess 46. When the power source 54 is operated, a current is introduced through the coiled wire winding 50 to create a magnetic field surrounding the wire. Preferably, at intervals along the outside diameter of the annular recess 46 and radially inward of the coiled wire winding 50, a plurality of strips of ferrous type metal (not shown) are placed to further develop the magnetic field surrounding the sleeve 44.

A waveguide 60 in communication with a conventional source of microwave energy 62 is presented through an opening in the jacket 42 and the sleeve 44 which provides the means for introducing microwave energy into the interior volume of the beating chamber 24. The microwave energy is introduced into the interior volume of the heating chamber 24 using conventional methodology known and used by those skilled in the art. The microwave source is capable of producing temperatures of at least 250° F. within the interior volume of the heating chamber 24. Although only a single waveguide 60 is shown in FIG. 2, a plurality of such waveguides in communication with the interior volume of the heating chamber 24 and connected to the microwave source can be provided as necessary.

In operation, a pre-determined amount of coal and aluminum oxide is introduced into hopper 28 and subsequently introduced into auger tube 20 through access opening 26. The motor 36 connected to auger 28 is turned on causing the auger 28 to rotate which mixes and moves the coal/aluminum oxide mixture toward the heating chamber 24. As the coal/aluminum oxide mixture enters the interior volume of the heating chamber 24, the source of microwave energy is turned on and the coal/aluminum oxide mixture is irradiated with microwave energy sufficient to produce a temperature of between about 250° F. and about 650° F. therein. This temperature is maintained for the desired period of time as the coal/aluminum oxide passes through the heating chamber 24. The movement of the coal/aluminum oxide is controlled by an electronic control mechanism (not shown) which can stop the auger 28 to halt movement of the coal/adsorbent mixture so as to subject it to the desired temperature for the desired period of time within the heating chamber 24. Simultaneously, the power source 54 providing current through the coiled wire winding 50 is also activated to provide the magnetic field surrounding the sleeve 44 in the heating chamber 24. It is believed that the provision of a magnetic field in this manner serves to concentrate the microwave energy introduced into the heating chamber 24 which assists in causing the release of sulfur from the coal without significantly reducing the BTU factor of the coal.

The coal/aluminum Oxide mixture is then moved by the auger 32 into the second auger tube 22 where it is conveyed toward discharge opening 29. Referring to FIG. 1, the auger tube 22 also presents a gas removal opening 63 (shown in phantom) connected by a pipe 64 which provides fluid communication between the heating section 12 and the gas treatment section 18 of the desulfurization system. The end of the pipe 64 opposite its end connected to the auger tube 22 is connected to a collecting conduit 66 which is connected by a pipe 15 to a source of vacuum 68, such as a compressor. The compressor, when activated, draws a vacuum through the pipe 64 and the conduit 66 which causes the gas released as a result of the irradiation of the coal/aluminum oxide mixture in the heating chamber 24 to be drawn from the heating section 12 and into the pipe 64, and ultimately into the conduit 66. The compressor is optionally controlled by a sensor means (not shown) positioned in the heating section 12, preferably in the auger tube 22 or the heating chamber 24, which is in communication with the compressor to activate the compressor depending upon the presence or absence of sulfur containing gas. If sufficient sulfur containing gas is present, the compressor is activated and a vacuum applied to conduit 66 which draws the gas out of the heating section 12. In a preferred embodiment, the vacuum drawn by the compressor 68 is constantly applied during the desulfurizing process. The gas flows through the pipe 64 and into collecting conduit 66 and then through a series of conventional heat exchangers 70 which cool the gas, which is approximately 300° F. as it leaves the tube 22, to about 70° F. After the gas has cooled, it is conveyed through pipe 65 to an accumulator tank 72. When desired, the gas in the accumulator tank 72 is introduced into a pressurizing cylinder 74 through a pipe 73 where it is subjected to sufficient pressure to cause it to be converted into liquid sulfuric acid. During normal operation of the desulfurizing process, sufficient water and oxygen are also present as vapors in the gas drawn from the heating section 12 to provide sufficient amounts of each to form sulfuric acid when exposed to a pressure of between 8–12 psi. Preferably, the pressurizing cylinder 74 is a floating-piston type hydraulic cylinder. The sulfuric acid formed in this manner is then transferred by a pipe 75 to a storage tank 76 for further processing or use. Although not shown, check valves are preferably positioned at intervals in the path of the vacuum in pipes 65 and 73 and in pipes 73 and 75 as a safety measure.

Figure 4:
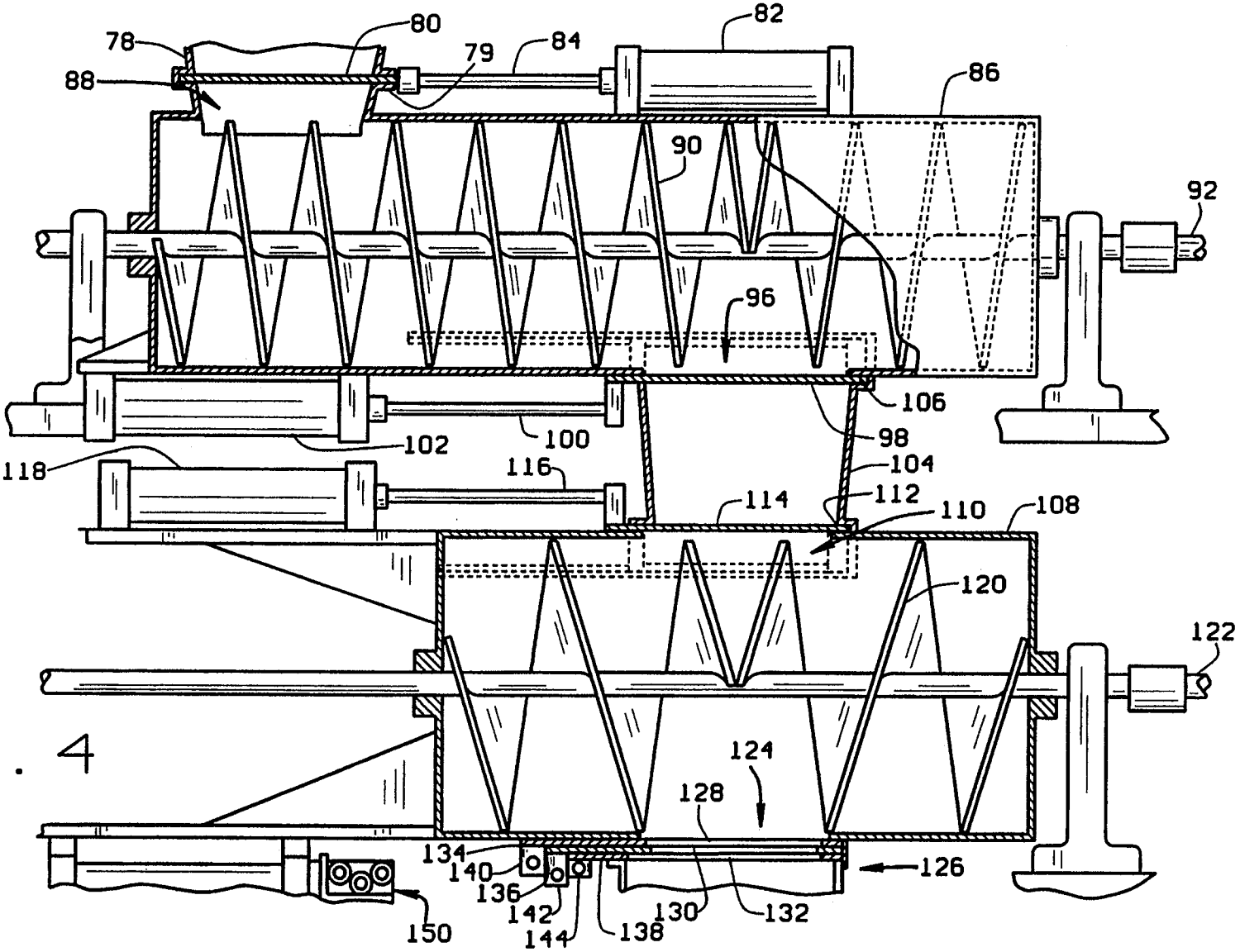
FIG. 4 is an enlarged front sectional view showing the mixing and screening sections of the embodiment of the present invention as shown in FIG. 1.

The coal and aluminum oxide combination discharged from the auger tube 22 through discharge opening 29 falls by gravity into chute 78 before entering mixing section 14. As best shown in FIG. 4, a gate 80 is positioned near the bottom of chute 78. Gate 80 is mounted for sliding movement relative to chute 78 and extends through a slot 79 provided in the chute 78. The movement of gate 80 regulates the introduction of the coal and aluminum oxide combination from the heating section 12 into the mixing section 14 of the desulfurizing system. The sliding movement of the gate 80 through slot 79 to permit entry of the coal/aluminum oxide combination into the mixing section 14 is actuated by a hydraulic or pneumatic cylinder 82. Preferably, a hydraulic type cylinder is used and is connected by conventional means to a supply of hydraulic fluid which causes reciprocating movement of a piston (not shown) in the cylinder in response to the introduction or exhaustion of the fluid in the cylinder. A rod 84 is connected to the piston and either extends from or retracts into the cylinder in response to the movement of the piston in the cylinder. The gate 80 is coupled to the distal end of the rod 84 so that the gate opens when the rod 84 is retracted into the hydraulic cylinder 82 and the gate closes when the rod 84 is extended from the hydraulic cylinder 82. While a hydraulic cylinder is described and shown, any linear actuator capable of controlling and regulating access between the chute 78 and the mixing section 14 could be utilized in connection with the present invention.

The mixing section 14 comprises a generally cylindrical mixing drum 86 having an access opening 88 positioned on the upper surface of the mixing drum and aligned with chute 78 to permit entry of the coal/aluminum oxide mixture into the interior volume thereof. An auger 90 is provided in the interior volume of the drum 86 and extends substantially the entire longitudinal length thereof. As shown in FIG. 1, the auger 90 is mounted for rotational movement within the interior volume of the mixing drum 86 by a drive shaft 92 which is connected in driving relationship to a motor 94. The auger 90 is designed so as to provide intimate blending of the coal and aluminum oxide and to move the coal/aluminum oxide mixture from the point where the mixture was introduced into the drum 86 to a discharge opening 96 provided in the underside of the drum near the end of the drum opposite the access opening. The coal/aluminum oxide combination is mixed in the mixing drum 86 for a period of time sufficient to cause any remaining sulfur in the atmosphere surrounding the coal or still being released from the coal to be adsorbed by the aluminum oxide. Preferably, the coal/aluminum oxide mixture is mixed in the mixing drum for between 2–20 minutes depending on the amount of coal being processed.

The discharge opening 96 remains closed during the mixing action by a gate 98 positioned below the opening. The gate 98 is positioned for sliding movement relative to the opening 96 and is coupled to a rod 100 of a hydraulic or pneumatic cylinder 102 that functions in a conventional manner. Briefly, when rod 100 is in the extended position, gate 98 is closed and when rod 100 is in the retracted position within cylinder 102, the gate 98 is open and permits the discharge of the coal/aluminum oxide mixture in mixing drum 86 to be discharged by gravity into chute 104.

Chute 104 provides the communication between the mixing section 14 and the screening section 16. The chute 104 is mounted below and substantially aligned with discharge opening 96 at its upper end and mounted to the top of screening drum 108 and positioned above and substantially aligned with an access opening 110 on the top of screening drum 108. An upper slot 106 is provided in chute 104 to facilitate the sliding movement of the gate 98 as described above and a lower slot 112 is provided in chute 104 to facilitate the sliding movement of a gate 114. The gate 114 operates in a manner identical to that as described for gates 80 and 98 above. Briefly, gate 114 is coupled to a rod 116 which is connected to a piston inside a hydraulic or pneumatic cylinder 118. The gate 114 is selectively opened or closed in response to the retraction or extension of the rod 116 into the cylinder 118, respectively.

An auger 120 is also provided in the interior volume of screening drum 108 and extends substantially the entire longitudinal length thereof. The auger 120 is mounted for rotational movement within the interior volume of the screening drum 108 and is connected to a drive shaft 122 which is in driving connection to a motor 124. The auger 120 is designed with blades which force all of the substance deposited in the drum 108 to move toward the middle of the drum.

The coal/aluminum oxide introduced into screening drum 108 through opening 110 is deposited substantially over an opening 124 in the underside of the screening drum. Mounted below the opening 124 is a series of screens designated generally by the numeral 126, of differing aperture size which permit the selective discharge of the coal or aluminum oxide in the screening drum based on the size of the particle.

Figure 7:
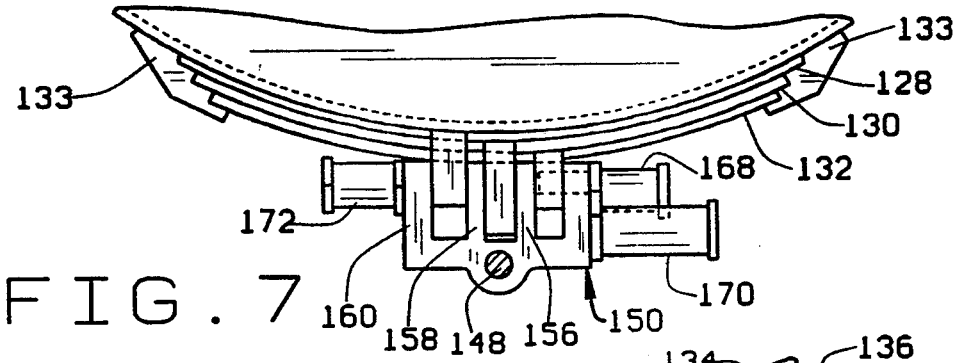
FIG. 7 is a view of the screening mechanism taken through the plane of the line 7—7 in FIG. 6.

In a preferred embodiment, three screens 128, 130 and 132 are employed which are positioned for sliding movement relative to the screening drum 108 by mounting brackets 133 secured to the exterior underside surface of screening drum 108. The screens are aligned below the opening 124 of the drum 108 and can be moved relative to the discharge opening 124 to selectively permit or restrict discharge of the substance in the drum. As shown in FIG. 7, the screens are preferably formed to be concentric with the cylindrical surface of the drum 108. The screen 128 is positioned closest to the opening 124 and has the smallest apertures of the three screens. The screen 128 permits only the discharge of the finer aluminum oxide particles and any dust or particulate matter from the drum 108 capable of flowing through the small openings. The screen 130 is positioned below screen 128 and has apertures of a size to permit medium and small particles of coal to pass therethrough, but not the largest coal particles. The lowermost screen 132 has the largest apertures and permits the discharge of only the largest size of coal particles from drum 108. As is apparent, when all three screens are positioned below opening 124, only the finest particles, such as the aluminum oxide particles, are permitted to be discharged from the drum 108.

Figure 6:
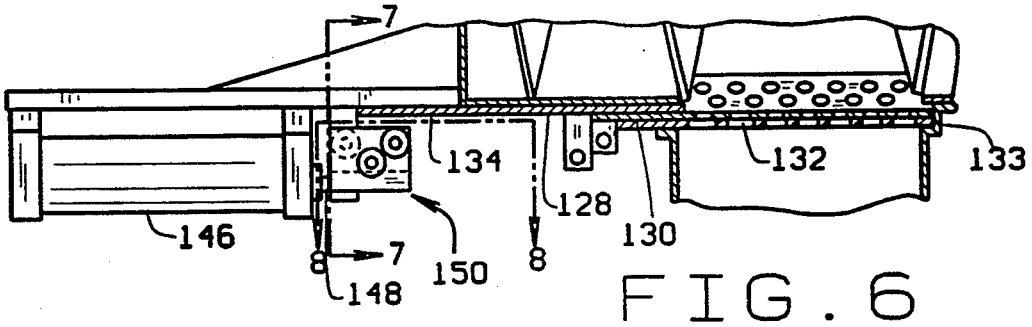
FIG. 6 is an enlarged partially sectional view illustrating the operation of the screening mechanism of the embodiment of the invention as shown in FIG. 4.

Each of the screens 128, 130 and 132 includes an arm 134, 136 and 138 respectively, extending from the respective screen. The arms 134, 136 and 138 are of differing lengths. A connector plate 140, 142, and 144 is presented at approximately the distal end of arms 134, 136 and 138, respectively, each of which includes an opening therethrough. As a result of the differing lengths of the respective arms connected to their respective screens, a staggered array of connector arms is presented as shown in FIG. 4. The screen arms and connector plates presented in this manner provide a means for selectively effecting the movement of one of the screens or a plurality of the screens to provide selective discharge of a desired substance from the drum 108. Referring now to FIG. 6, the mechanism by which selective movement of the individual screens is effected, and thereby selective discharge of the contents of the screening drum 108, is illustrated.

Figure 9:
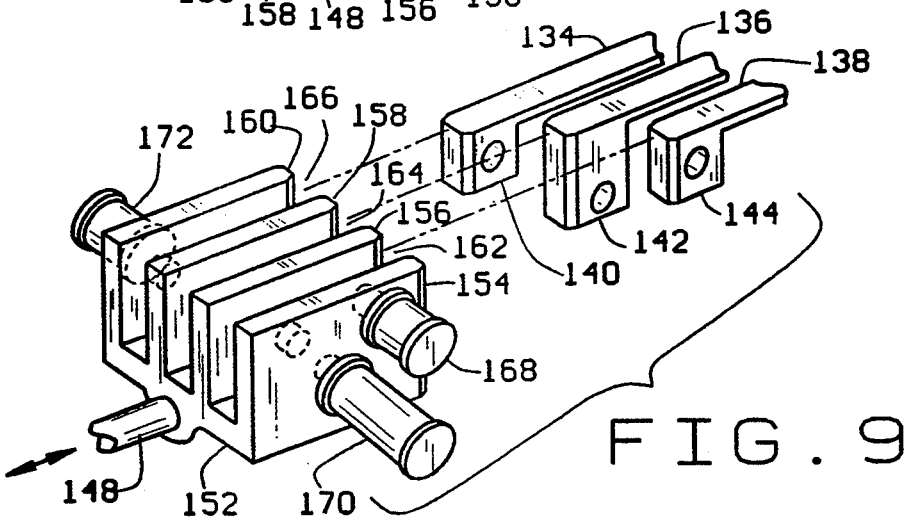
FIG. 9 is an exploded view of the mechanism by which the screens are selectively withdrawn to permit selective discharge of a substance from the screening section of the embodiment of the invention as shown in FIG. 1.
Figure 8:
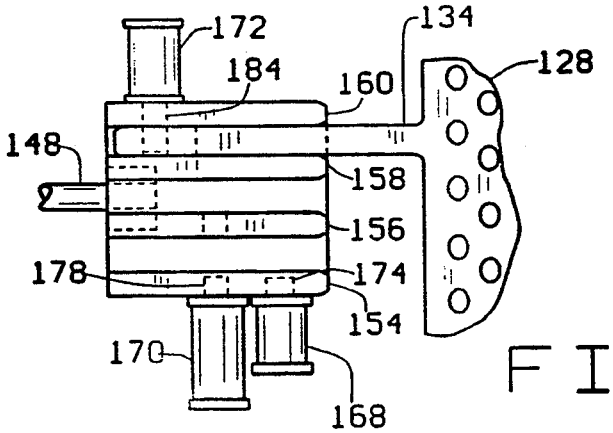
FIG. 8 is an enlarged view of the screening mechanism taken through the plane of the line 8—8 in FIG. 6.

A pneumatic or hydraulic cylinder 146 of the type described above is mounted to the underside of the screening drum 108. The cylinder rod 148 of the cylinder 146 is connected to a yoke 150. As best shown in FIG. 9, the yoke 150 is comprised of a bottom plate 152 and four substantially perpendicular walls 154, 156, 158 and 160 extending upwardly therefrom. Three channels 162, 164, and 166 are formed between these walls. As shown in FIGS. 7–9, two solenoids 168 and 170 are mounted to the outer surface of wall 154 and one solenoid 172 is mounted to the outer surface of wall 160. Referring to FIG. 8, an opening 174 (shown in dotted lines) aligned substantially with solenoid 168 is presented in wall 154 to receive the pin (not shown) of solenoid 168 therethrough, openings 178 and 180 (shown in dotted lines) substantially aligned with solenoid 170 are presented in walls 154 and 156, respectively, to receive the pin (not shown) of solenoid 170 therethrough, and an opening 184 (shown in dotted lines) substantially aligned with solenoid 172 is presented in wall 160 to receive the pin shown in dashed lines of solenoid 172 therethrough. Each of solenoids 168, 170 and 172 is of conventional design and has a pin therein which is extended from or retracted into the solenoid by selective operation of the solenoid. The solenoids are connected to a suitable power source.

The yoke 150 is positioned in a manner such that when the yoke 150 is in its extended position, the connector plates 144, 142 and 140 are received within the channels 162, 164 and 166, respectively, and the openings in the respective connector plates align with at least one of the openings in the walls 154, 156 or 160. In particular, the opening in the connector arm 140 aligns with the opening 184, the opening in the connector arm 142 aligns with the openings 179 and 180, and the opening in the connector arm 144 aligns with the opening 174. Thus, when the yoke 150 is in its extended position, one of the solenoids 168, 170 or 172 can be operated to cause its pin to be extended through the respective openings which will engage the desired screen. Yoke 150 is then retracted which concomitantly slides the engaged screen therewith, leaving the remaining screens in place. By sequentially extending the yoke to engage the connector plates and sequentially extending a desired solenoid pin into the desired opening in the connector plate to engage a desired screen, each of the screens can be withdrawn individually which permits the selective discharge of the desired substance from the screening drum 108. In the preferred embodiment as shown in FIGS. 6–9, the screen 128 having the smallest openings is withdrawn first, followed by screens 130 and 132. Of course, it is within the scope of the invention to reverse the placement of the screens so that the screen with the largest openings is positioned closest to the drum 108 and it can be withdrawn first or a plurality of the screens may be withdrawn in one movement depending upon the nature of the size of substance in the drum and the arrangement and placement of the connector arms to permit the desired sequence of screens to be moved. It is preferred that the movement of the screens be synchronized with the introduction of the coal/adsorbent mixture into the screening drum 108. That is, after the coal/adsorbent mixture is introduced into screening drum 108, the mixture is mixed for a desired period of time and then the screens sequentially withdrawn until all the screens have been withdrawn and all the contents in the screening drum 108 removed. The screens are then returned to their position below the drum 108 and the next batch of coal/adsorbent is introduced by the operation of the gates 98 and 114. These gates and screens can be controlled by conventional control mechanisms and systems.

Figure 5:
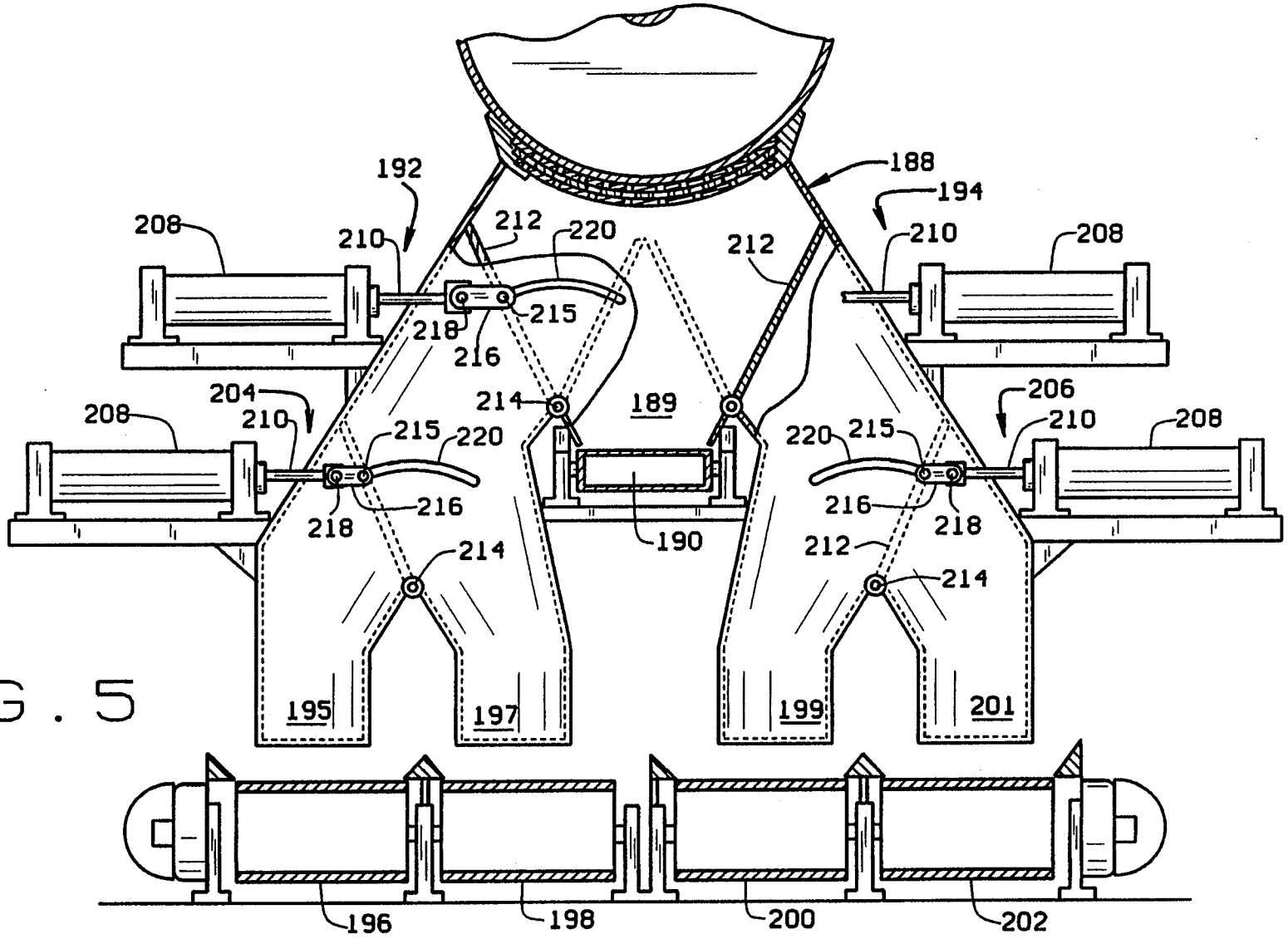
FIG. 5 is an enlarged cross sectional view of the delivery chute of the embodiment of the invention as shown in FIG. 1.

Referring now to FIG. 5, a chute 188 is mounted to the exterior surface of screening drum 108 and is substantially aligned below the series of screens 126 positioned on the underside of drum 108. The chute 188 provides a pathway for the substance being discharged from the screening drum 108 to be directed to a desired conveyor. As shown in FIG. 5, a preferred embodiment of chute 188 provides five different pathways through which the coal or aluminum oxide can be moved depending upon the positioning of four gate mechanisms associated with chute 188.

A first pathway 189 directing the discharged substance onto a conveyor 190 is provided by gate mechanisms 192 and 194 being in the closed or retracted positions as shown in FIG. 5. When the gate mechanisms 192 and 194 are in the open or extended positions, as shown in phantom in FIG. 5, the substance being discharged is directed to either the two pathways 195 and 201 that direct the substance onto conveyors 196 and 202 or the two pathways 197 and 199 that direct the substance onto conveyors 198 and 200. When gate mechanisms 204 and 206 are in the closed or retracted positions as shown in FIG. 5, the substance is directed into the pathways 197 and 199 discharging onto conveyors 198 and 200. When the gate mechanisms 204 and 206 are in the open or extended positions, the substance is directed into the pathways 195 and 201 discharging the substance onto conveyors 196 and 202. Preferably, the aluminum oxide particles are discharged through pathway 189 onto conveyor 190 and the coal particles are discharged onto any of conveyors 196, 198, 200 and 202 through pathways 195, 197, 199 and 201, respectively.

The gate mechanisms 192, 194, 204 and 206 are identically constructed and are mounted to chute 188 for pivotal movement therein. Each gate mechanism comprises a hydraulic or pneumatic cylinder 208 with a cylinder rod 210 coupled to a gate 212. Each of gates 212 is pivotally mounted to chute 188 by a pin 214 near the bottom of the gate 212 and is rigidly secured to a pivoting bracket 216 by a pin 215 at a point near the top of gate 212. The pivoting bracket 216 is mounted for pivoting movement with respect to rod 210 by a pin 218 so that as rod 210 is extended from cylinder 208, pin 215 of the pivoting bracket 216 moves through the arcuate slot 220 and moves gate 212. To accommodate movement through the arcuate slot 220, bracket 216 pivots about pin 218. This connection permits gate 212 to move in an arc to permit or restrict access to a desired pathway.

In a preferred embodiment, a plurality of apparatuses 11 are provided as shown in FIG. 1. Each of the apparatuses 11 operate individually but are connected and controlled by a control mechanism in such a manner as to permit the apparatuses 11 to operate in unison. Thus, one set of operation controls can be provided to control all of the operations of each of the individual apparatuses 11. This permits sequential batches of coal/aluminum oxide to be processed in a continuous manner. As shown in FIG. 1, three such apparatuses 11 are provided, but it is envisioned that six or more such apparatuses 11 can be linked together to provide an economic and efficient system 10 for desulfurizing coal.

The following example is provided to better elucidate the practice of the present invention and should not be interpreted in any way to limit the scope of the present invention. Those skilled in the art will recognize that various modifications can be made to the method and apparatus described herein without departing from the spirit and scope of the present invention.

EXAMPLE 1

To illustrate the effectiveness of the method of this invention, coal from Kentucky Mountain Coal Co., Inc. certified as having 4.5% sulfur on a dry weight percent basis was obtained and tested in a prototype apparatus capable of performing the method of this invention. Approximately 25 pounds of coal and approximately 2 pounds of aluminum oxide particles were placed into a granitoid-type vessel which was adapted for rotating movement. The vessel was connected to a microwave power source and included a copper coil wire winding surrounding the exterior of the vessel. The wire winding was connected to an electric power source to induce a magnetic field around the vessel. The vessel was also connected to a vacuum system by a hose between the vessel and a compressor to permit the removal from the vessel of any gas liberated by the coal during the heating process. The rotational movement of the vessel and the vacuum system were activated and the microwave and electric power sources turned on. The coal was then irradiated with microwave energy of about 900 watts at a frequency of between 2000 MHz and 4000 MHz for a period of 6 minutes. A temperature of approximately 400° F. was achieved in the vessel. The gas released during the irradiation treatment was removed from the vessel by the vacuum supplied to the vessel. The aluminum oxide was separated from the coal and the coal analyzed for sulfur content.

Five (5) repetitions of this experiment were performed and the amount of sulfur remaining in the coal determined. The percentage of total sulfur in the treated coal ranged from 1.69% to 0.78% on a dry weight basis. The average percentage of sulfur remaining in the coal for the five experiments was 1.19% which represented an average reduction of sulfur in the coal of approximately 75%.

From the foregoing, it will be seen that this invention is one well adapted to attain all the advantages and objects hereinabove set forth together with other advantages which are inherent to the invention.

As many possible embodiments may be made of the invention without departing from the scope hereof, it is to be understood that all matters herein set forth or shown in the accompanying drawings is to be interpreted as illustrative and not in a limiting sense.

What is claimed is:

1. A method for desulfurizing coal comprising the steps of:

combining sulfur-containing coal with aluminum oxide particles in a vessel with a means for providing a magnetic field around said vessel;

irradiating said coal and aluminum oxide combination with sufficient microwave energy and concentrating the microwave energy being introduced into said vessel within the vicinity of the magnetic field to subject said combination to a temperature of between about 250° F. and about 650° F. for a period of time sufficient to cause the release of sulfur from said coal as a gas;

removing said gas released in said vessel;

admixing said coal and aluminum oxide combination in a manner enabling the adsorption of any remaining gaseous sulfur onto said aluminum oxide particles; and separating said aluminum oxide particles from said coal.

2. The method as set forth in claim 1 wherein said coal and aluminum oxide combination is subjected to a temperature of between about 250° F. and about 450° F. for a period of time sufficient to cause the release of sulfur from said coal as a gas.

3. The method as set forth in claim 2 wherein said microwave energy is between about 200 and about 4000 watts at a frequency of about 2000 to about 4000 MHz.

4. The method as set forth in claim 3 wherein said ratio of coal to aluminum oxide is about 10:1.

5. The method as set forth in claim 4 wherein a vacuum is applied to said vessel to remove said gas released in said vessel.

6. The method as set forth in claim 1 wherein said method further comprises moving said coal and aluminum oxide combination through said vessel as said combination is being irradiated.

7. The method as set forth in claim 6 further comprising the step of transferring said coal and aluminum oxide combination to a second vessel prior to said admixing step.

8. An apparatus for desulfurizing coal in the presence of a sulfur adsorbent comprising:

a first vessel having an interior volume, said first vessel having an access opening at a first end for receiving said coal and said adsorbent into said vessel, a discharge opening at a second end, a means for irradiating said coal and said adsorbent received therein with an effective amount of microwave energy to cause the release of sulfur from said coal as a gas, and a means for moving said coal and said adsorbent from said first end to said second End of said first vessel; and a means for providing a magnetic field between said first and second ends of said first vessel;

a means in communication with said first vessel for removing said gas released therein;

a second vessel having an interior volume, said second vessel having an access opening to receive said coal and adsorbent from said first vessel, a discharge opening, and a means for mixing and moving said coal and said adsorbent from said access opening to said discharge opening of said second vessel;

a third vessel having an interior volume, said third vessel having an access opening to receive said coal and adsorbent from said second vessel, a discharge opening, a means for moving said coal and said adsorbent from said access opening to said discharge opening, and a means for discharging said coal and said adsorbent from said third vessel.

9. The apparatus of as set forth in claim 8 further comprising a means for directing said coal and said adsorbent discharged from said third vessel to individual receiving means.

10. The apparatus as set forth in claim 9 wherein said means for directing said coal and said adsorbent discharged from said third vessel to individual receiving means comprises:

a conduit positioned below said discharge opening and aligned substantially therewith to receive the coal or the adsorbent discharged from said third vessel, said conduit having at least two pathways to direct the coal and adsorbent to individual receiving means; and a means for selectively providing access to one of said at least two pathways.

11. The apparatus as set forth in claim 10 wherein said individual receiving means comprises at least two conveyor assemblies suitable for receiving said coal or said adsorbent thereon and for conveying said coal or adsorbent to individual storage receptacles.

12. The apparatus as set forth in claim 8 wherein said gas, removal means includes a conduit connected to and in communication with the interior volume of said first vessel, a means for applying a vacuum within said conduit, and a storage receptacle whereby when the vacuum is applied the gas is transported from the first vessel through the conduit into the storage receptacle.

13. The apparatus as set forth in claim 8 wherein said means for discharging said coal and said adsorbent from said third vessel includes a plurality of individual screens of differing aperture size mounted to an exterior surface of, and aligned substantially below, said discharge opening of said third vessel for sliding movement relative to said discharge opening and means for selectively effecting the movement of at least one of said plurality of screens to permit the selective discharge of said coal and said adsorbent from said vessel capable of passing through said apertures in said screen.

14. The apparatus as set forth in claim 13 wherein at least three individual screens of differing aperture size are mounted to the exterior surface of and aligned below the discharge opening of said third vessel, one of said at least three screens has apertures sized to permit the discharge of said adsorbent from said third vessel and two of said at least three screens have apertures sized to permit the discharge of different sizes of coal from said third vessel.

15. The apparatus as set forth in claim 13 wherein the individual screens are moved in a sequential manner to permit the selective discharge of the adsorbent and the coal from the vessel on the basis of the size of the coal and adsorbent.

* * * * *